United States Patent [19]

King

[11] 3,951,764

[45] Apr. 20, 1976

[54] ALUMINUM-MANGANESE ALLOY

[75] Inventor: William R. King, Livermore, Calif.

[73] Assignee: Kaiser Aluminum & Chemical Corporation, Oakland, Calif.

[22] Filed: Feb. 10, 1975

[21] Appl. No.: 548,496

Related U.S. Application Data

[62] Division of Ser. No. 446,885, Feb. 28, 1974, abandoned.

[52] U.S. Cl. ..... 204/71; 75/135; 75/138

[51] Int. Cl.[2] ..... C25C 3/36

[58] Field of Search ..... 75/135, 138 R; 204/71, 204/67

[56] References Cited

UNITED STATES PATENTS

| | | | |
|---|---|---|---|
| 1,464,625 | 8/1923 | Pacz | 204/71 |
| 3,018,233 | 1/1962 | Welsh et al. | 204/71 X |
| 3,855,087 | 12/1974 | Yamanaka et al. | 204/71 |

*Primary Examiner*—L. Dewayne Rutledge
*Assistant Examiner*—E. L. Weise
*Attorney, Agent, or Firm*—Paul E. Calrow; Andrew E. Barlay

[57] ABSTRACT

Aluminum-manganese alloys containing up to about 10.0% by weight manganese are made by reacting molten aluminum with a manganese oxide, such as MnO or $MnO_2$, under a blanket of fluoridic salts, for example cryolite. The alloy can also be prepared by electrolyzing the oxides of aluminum and manganese in a fluoridic bath using aluminum metal as cathode.

3 Claims, No Drawings

ALUMINUM-MANGANESE ALLOY

This is a division of application Ser. No. 446,885 filed on Feb. 28, 1974 now abandoned.

BACKGROUND OF THE INVENTION

Aluminum-manganese alloys containing up to about 1.5% by weight manganese are widely used for the manufacture of rolling stock and aluminum-manganese alloys containing in excess of about 1.5% and up to about 10.0% by weight of manganese are employed as master alloys for the preparation of manganese containing aluminum alloys, for example Al-Mn-Si and Al-Mn-Mg. Preparation of aluminum-manganese alloys in the past has generally been accomplished by incorporation of highly pure manganese in molten aluminum. This procedure requires highly pure manganese metal and as manganese is usually made by either blast furnace beneficiation of manganese containing ores or from ferromanganese alloys, the manganese metal resulting from these processes must be purified to render it suitable as an alloying element for aluminum. Impurities, which are extremely hard to remove from manganese metal, include carbon and iron and it is known that these impurities, when incorporated in aluminum may impart undesirable properties to the alloy. Consequently, in order to avoid introduction of unwanted impurities into the aluminum-manganese alloy, the manganese must be subjected to extensive and expensive purification processes.

It has now been discovered that aluminum-manganese alloys containing up to about 9% by weight manganese can be readily and efficiently prepared from oxides of manganese rather than from manganese metal. The novel method eliminates the need for making high purity manganese metal and allows the preparation of aluminum-manganese alloys having controlled manganese content and high purity.

SUMMARY OF THE INVENTION

Aluminum-manganese alloys, containing up to about 10% by weight manganese, are prepared by adding to aluminum a manganese oxide selected from the group consisting of MnO, $MnO_2$ and their mixtures. The aluminum is maintained under a cover of fluoridic salts, such as $Na_3AlF_6$, the melting point of which exceeds that of aluminum and the mixture is heated to at least sbout the melting point of the fluoridic salt which will render both the aluminum and the fluoridic salt molten. Agitation of the molten mixture allows intimate contact of the manganese oxide with the molten Al, resulting in reduction of the oxide to manganese metal and incorporation of the manganese in the aluminum. Aluminum oxide ($Al_2O_3$) formed by the reaction will dissolve in the fluoridic salt.

The manganese oxide can also be added to already molten aluminum in a blend with the fluoridic salt or if desired to a molten mixture of aluminum and fluoridic salt. Incorporation of manganese in aluminum can also be achieved by electrolysis under agitation of a mixture of $Al_2O_3$ and manganese oxide using molten aluminum as cathode, the molten aluminum being covered by a molten layer of fluoridic salt.

DETAILED DESCRIPTION OF THE INVENTION

This invention concerns the preparation of aluminum-manganese alloys containing up to about 10.0% by weight manganese. More particularly, it relates to the preparation of aluminum-manganese alloys by treating molten aluminum with oxides of manganese under a blanket of fluoridic salts, such as cryolite.

In an advantageous embodiment, the aluminum-manganese alloy is prepared by electrolysis of a mixture of alumina ($Al_2O_3$) and oxides of manganese, such as $MnO_2$ and/or MnO in a cryolitic bath using as cathode aluminum metal.

For the purposes of this invention, the term "aluminum" refers to aluminum metal having a purity of 99.9%, the balance being trace impurities, such as Mg, Si, Cu or the like. The terms "manganese oxides" and "oxides of manganese" as used hereinafter encompass MnO and $MnO_2$ and their mixtures. For best results, these manganese compounds should have a purity of at least about 99.8%.

It is known that the solubility of manganese in aluminum depends on the temperature. Thus, for example, at the eutectic temperature of 658.5°C, 1.40% weight manganese dissolves in aluminum. At increased temperatures, i.e. in excess of about 660°C, the solubility of manganese increases in aluminum and at temperatures at about 785°–790°C, up to about 10% by weight manganese can be incorporated in aluminum.

In accordance with the instant invention, aluminum-manganese alloys containing varying quantities of manganese up to about 10% by weight can be conveniently and efficiently produced by utilizing the reactions between manganese oxides and molten aluminum as shown below.

$$3MnO_2 + 4Al \rightarrow 3Mn + 2Al_2O_3 \quad (1)$$

$$3MnO + 2Al \rightarrow 3Mn + Al_2O_3 \quad (2)$$

Manganese, according to both equations (1) and (2), forms by the oxidation of molten aluminum to aluminum oxide ($Al_2O_3$) and the formed manganese metal then dissolves in the molten aluminum provided in an amount sufficient to obtain the desired aluminum-manganese alloy compositions. In order to promote the reaction between the manganese oxides and the molten aluminum, the $Al_2O_3$ reaction product should be removed from the reaction mixture. In addition, to obtain a pure aluminum-manganese alloy free of aluminum oxide inclusions, it is advisable to remove from the mixture the $Al_2O_3$ as rapidly as it forms. Removal of $Al_2O_3$ from the reaction mixture can be conveniently achieved by providing a molten salt bath which is capable of dissolving aluminum oxide. Suitable molten salts which possess these characteristics include fluoridic salts and mixtures thereof. For example, molten cryolite ($Na_3AlF_6$) at 1000°C is capable of dissolving about 20–25% by weight $Al_2O_3$, other molten fluoridic salts, such as $AlF_3$ or $CaF_2$, can also be employed although the solubility of $Al_2O_3$ in these molten salts is lower. Mixtures of, for example, cryolite, $CaF_2$ and/or $AlF_3$, can also be readily employed. A further advantage of using a molten fluoridic salt bath as a scavenger for formed $Al_2O_3$ is in the lower density of these molten salts in comparison to molten aluminum and molten aluminum-manganese alloy. As a result of this density difference, the molten salt bath will cover the surface of the molten aluminum and will serve as a protecting blanket against undesired oxidation of the molten aluminum and/or aluminum-manganese alloy.

In case the aluminum-manganese alloy is prepared by admixture of molten aluminum and solid $MnO_2$, it is necessary to provide agitation for intimate contacting of the $MnO_2$ powder or particles with the molten aluminum and uniform distribution of the formed manganese metal in the aluminum. Additionally, agitation is desirable to allow the formed $Al_2O_3$ to contact the molten salt bath for a sufficient time to allow dissolution of the alumina in the bath and thus remove the possibility of $Al_2O_3$ inclusions in the molten aluminum-manganese alloy. Preferably, agitation is conducted in such a manner as to avoid contact of air with the surface of the molten metal. This type of agitation can be readily achieved by using, for example, conventional agitators, made from metals which are not only temperature resistant at the aluminum-manganese alloy formation temperature, but are also inert to both the salt bath and the molten Al-Mn. It is known to use for metal agitation agitators made from stainless steel, having a fluoridic salt resistant refractory metal oxide sleeve at the contact areas with the molten salt bath. The refractory metal oxide sleeve with its close fitting arrangement with the stainless steel agitator prevents contact of the molten metals with the oxidizing atmosphere, such as air. If desired, air can be kept away from the molten salt bath surface by an inert gas sweep, for example, argon.

The quantity of $MnO_2$ or MnO to be added to the molten aluminum depends on the composition of the aluminum-manganese alloy desired. Due to a slight solubility of the manganese oxides in the fluoridic salt bath, it is advisable to employ a small excess of MnO and/or $MnO_2$ over the calculated quantity. The excess of manganese oxides to be added to the reaction is generally in the neighborhood up to about 15% over the calculated amount.

The reaction between the manganese oxides and the molten aluminum proceeds relatively rapidly under agitation, for example alloy batches of 1000 grams or less can be readily made in less than about 40 minutes. Larger alloy quantities, i.e. 100 kg or more, under efficient agitation, can be made in less than about 2–4 hours.

Subsequent to the incorporation of the manganese in the molten aluminum, the formed alloy is separated from the molten salt bath by conventional techniques, for example by bottom pouring. After solidification of the aluminum-manganese metal, adhered solidified salt bath residue, if any, is removed from the alloy surface, for example by washing with water and/or nitric acid. The solidified alloy is then ready for further processing and use, which depending on the manganese content, can be either by rolling or as a master alloy to incorporate manganese in other aluminum alloys.

Another advantageous embodiment of the instant invention concerns the preparation of aluminum-manganese alloys by electrolysis. In the electrolytic process,, the manganese oxides are electrochemically reduced to manganese metal when the electrolysis cell also contains $Al_2O_3$ and as cathode aluminum is employed.

The electrolytic manufacture of aluminum-manganese alloys in accordance with the instant invention is based on the same principle as the addition of $MnO_2$ or MnO to molten aluminum under a protective blanket of a molten fluoridic bath. According to the present invention, the aluminum-manganese alloy is prepared in a conventional cell used for the manufacture of aluminum, such as the Hall cell. Using the molten aluminum as cathode and a carbon electrode as anode, the cell can be operated in the same manner as the cell employed in producing aluminum from alumina with a fluoridic bath, such as cryolite, as a solvent for $Al_2O_3$. In this cell MnO and/or $MnO_2$ is added in an amount sufficient to obtain an aluminum-manganese alloy of desired manganese content. It is advisable, just as has been discussed above, to employ a slight excess of MnO and/or $MnO_2$ over the calculated amount, since due to the solubility of manganese oxide in the fluoridic bath, some losses in Mn content can be expected. Usually, addition of a 10–15% excess of manganese oxide over the calculated quantity results in a very close approximation of the calculated manganese content in the aluminum-manganese alloy.

Depending on the cell size, the cell can be operated at any desired amperage and at a voltage from about 2 to about 5 volts and at a temperature between about 900°C and 1100°C.

The manganese oxides are fed to the cell in a continuous or batch manner and the formed aluminum-manganese alloy can be tapped from the cell in a continuous or discontinuous fashion. Manganese oxide added to the bath will be reduced to manganese at the molten aluminum cathode and it will be then incorporated in the aluminum. Slight agitation of the molten aluminum layer will result in more intimate contact with the manganese oxide and also in a uniform distribution of the formed manganese in the aluminum. The addition of manganese oxides to the conventional Hall cell or other aluminum producing cells, does not interfere with the electrolysis and no evidence has been found that incorporation of up to about 10% by weight manganese in the molten aluminum would significantly reduce the efficiency of the cell operation.

The tapped aluminum-manganese alloy can be processed in any desired manner; ingots can be formed for use either as rolling stock or as master alloy.

The following examples will further illustrate the novel aspects of the present invention.

EXAMPLE I

An aluminum-manganese alloy was prepared in an alumina crucible from 4.98 grams of aluminum of 99.99% purity. The aluminum was covered with a mixture of 10.0 grams of cryolite ($Na_3AlF_6$) and 0.157 gram of $MnO_2$. The crucible and its contents were heated to 1000°C and agitated by gently swirling the crucible. After about 20 minutes at 1000°C, the melt was poured onto a graphite plate and was allowed to cool. Subsequently, the alloy surface was freed of adhered cryolite by washing with water and nitric acid and after drying, the alloy was analyzed spectrographically for manganese. According to the quantity of $MnO_2$ added to the molten aluminum, the alloy should have contained 1.98% by weight manganese, analysis indicated the presence of 1.8% by weight manganese uniformly distributed in the aluminum matrix.

The test was repeated by incorporating a 10% excess of $MnO_2$ (0.172 gram versus 0.157 gram) in the melt and the aluminum-manganese alloy obtained contained the desired 1.98% by weight manganese content.

EXAMPLE II

An alumina crucible was charged with 5.425 grams of aluminum of 99.99% purity. 10.0 grams of $Na_3AlF_6$ were blended with 0.6221 gram of $MnO_2$ (calculated $MnO_2$ quantity to obtain an aluminum-manganese alloy of 7% by weight manganese content) and the blend was placed on the top of the aluminum. The crucible was slowly introduced into a furnace kept at 1000°C and after a 15 minute residence time, the contents of the crucible were agitated by gentle swirling. The crucible was then returned to the furnace and the agitation was repeated twice at 10 minute intervals. After a total of about 40 minutes residence time in the furnace, the melt was poured onto a graphite plate and was allowed to cool. After purification of the surface of the formed alloy, it was spectrographically analyzed and a manganese content of 6% was found to be uniformly distributed in the aluminum matrix. The test was repeated using 0.700 gram $MnO_2$ and the formed alloy then contained the desired 7% by weight manganese content.

EXAMPLE III

An aluminum-manganese alloy, containing 2% by weight manganese, was prepared by electrolysis. In a graphite lined crucible a layer of molten aluminum made from a measured quantity of aluminum was established by heating the aluminum to a temperature in excess of 800°C. The molten aluminum layer was then connected to the negative pole of a direct current power supply and the surface of the molten aluminum was covered with a layer of cryolite. A prebaked carbon anode rod was then immersed in the cryolite and the system was kept at about 960°C to melt the cryolite. The anode was then connected to the positive pole of the power supply and under stirring with an aluminum rod, alumina mixed with $MnO_2$ was slowly added to the molten bath so that the mixture could contact the molten aluminum. The quantity of $MnO_2$ added was sufficient to produce an aluminum-manganese alloy containing 2% by weight manganese ($MnO_2$ quantity = calculated quantity + 10% excess). A voltage of 3 volts and an amperage of 15 amperes was then established in the system. After a 60 minute electrolysis, the anode was removed and the molten bath was poured onto a graphite plate. After removal of surface adhered impurities by washing with water and nitric acid, the alloy was spectrographically analyzed and a manganese content of about 1.95% by weight of the alloy was found to be uniformly distributed in the aluminum metal.

What is claimed is:

1. In the process of producing aluminum by electrolysis of $Al_2O_3$ feed in the presence of a molten fluoridic salt, which serves as a cover layer for the produced molten aluminum and which dissolves $Al_2O_3$, and wherein the produced molten aluminum is connected as cathode in the electrolysis, the improvement which comprises a. simultaneously producing an aluminum-manganese alloy containing up to about 10% by weight manganese by incorporating in the $Al_2O_3$ feed a manganese oxide selected from the group consisting essentially of MnO, $MnO_2$ and mixtures thereof in an amount in excess over the calculated quantity required for the production of an aluminum-manganese alloy having a desired manganese content:

b. agitating the molten aluminum to obtain intimate contact between the manganese oxide and the aluminum for a time sufficient to allow for the reduction of manganese oxide to manganese and for the uniform distribution of the manganese in the aluminum; and c. recovering the aluminum-manganese alloy of desired manganese content.

2. Process according to claim 1, wherein the fluoridic salt is cryolite.

3. Process according to claim 1, wherein the excess of manganese oxide over the calculated quantity required is up to about 15% by weight.

* * * * *